US011443664B1

(12) United States Patent
Angel

(10) Patent No.: US 11,443,664 B1
(45) Date of Patent: Sep. 13, 2022

(54) TRANSFORMATIVE DISPLAY SCENE

(71) Applicant: Angel Productions Worldwide Inc., Las Vegas, NV (US)

(72) Inventor: Criss Angel, Las Vegas, NV (US)

(73) Assignee: Angel Productions Worldwide Inc., Las Vegas, NV (US)

( * ) Notice: Subject to any disclaimer, the term of this patent is extended or adjusted under 35 U.S.C. 154(b) by 0 days.

(21) Appl. No.: 17/346,958

(22) Filed: Jun. 14, 2021

(51) Int. Cl.
*G09F 11/30* (2006.01)
*G09F 7/20* (2006.01)

(52) U.S. Cl.
CPC ..... *G09F 11/30* (2013.01); *G09F 7/205* (2021.05)

(58) Field of Classification Search
CPC . G09F 11/30; G09F 7/205; G09F 1/06; A63H 33/06; A63H 33/04; A63H 3/52
See application file for complete search history.

(56) References Cited

U.S. PATENT DOCUMENTS 347,682 A * 8/1886 Buckingham ..... A63H 3/52 446/109
2,408,272 A * 9/1946 Roach ..... A63H 3/52 446/109
6,575,803 B1 * 6/2003 Liu ..... A63H 3/08 446/85
6,631,590 B1 * 10/2003 Glowaski ..... A01K 1/033 52/63
7,241,198 B1 * 7/2007 Boone ..... A63H 3/52 446/110
2003/0097773 A1 * 5/2003 Oh ..... G09F 1/06 40/124.08
2007/0224912 A1 * 9/2007 Hughes ..... A63H 3/52 446/476
2010/0293823 A1 * 11/2010 Hsu ..... B42D 15/045 40/124.191

* cited by examiner

*Primary Examiner* — Gary C Hoge
(74) *Attorney, Agent, or Firm* — Wissing Miller LLP

(57) ABSTRACT

There is disclosed a transformative display that, in a first configuration, appears as a first scene. A mechanism is provided to cause elements of the display to move from the first configuration to a second configuration, displaying a second, different scene. The elements are in the form of panels that fit into recesses in a platform in the first configuration. These panels may include features that extend above the surface of the platform to form other elements of the first scene. When the display moves to the second configuration, the panels swing upward from the platform, creating elements of the second scene. In the second configuration, features extending from the panels meet to other elements of the second scene.

17 Claims, 18 Drawing Sheets

TRANSFORMATIVE DISPLAY SCENE

BACKGROUND

Field

The present application relates to artistic scenery, models, dioramas, and structures that can change appearance by operation of a mechanical or electro-mechanical mechanism. In particular, the present application discloses a scenery, model, diorama, or structure that, in a first configuration shows an artistic representation of a first scene, and after actuation of the mechanism, changes to a second configuration to show a representation of a second, different scene.

Description of the Related Art

Hobbyists and decorators sometimes create scenes representing actual or fanciful landscapes. These landscapes may include electrically operated vehicles, for example, model trains, electric "slot" cars, and the like. These scenes sometimes include buildings and other structures intended to create the impression of a situation, for example, of a building in the winter season. The scene might include elements that suggest to the viewer a holiday, for example, Christmas. The scene might include painted surfaces representing snow, iconic figures like reindeer, snowmen, decorated trees, and the like. Miniature models of houses and other structures used to create such scenes are well known.

Known miniature models have a fixed shape and appearance. A model of a shop, for example, may include signage, windows, and lighting to create the impression of a particular type of shop, such as a candy shop. While such a model might include movable features, such as a door that can be opened and closed, the overall shape and appearance of the model does not change.

Hobbyists wishing to create a landscape with moving vehicles may also wish to have a scene or landscape that transforms from one configuration to another. Such a transformation might represent the passage of time, for example, from a summer season to a winter season. It would be an advancement in the art to provide a scene that can transform from one configuration to another rapidly to create the illusion of an instantaneous transformation.

SUMMARY

The present disclosure relates to scenery, model, diorama, or structure that can dynamically transform from one configuration or appearance to another configuration or appearance.

According to one aspect, there is disclosed a miniature model of a building that, in one configuration, shows the building with a first appearance, for example, in a warm season of the year. The model includes a mechanism that causes the model to transition to a second configuration with a second appearance, for example, the same building in wintertime decorated for the Christmas holiday season.

According to another aspect, there is disclosed a miniature scene of construction site representing a building under construction that includes hidden panels that are mechanically actuated to hide the elements of the construction site and to form the scene of a finished building.

According to another aspect, there is disclosed a scene of a landscape, for example, a graveyard that includes hidden panels that are mechanically actuated to hide the elements of the landscape and show a structure, such as a magician's shop.

According to one embodiment of the disclosure there is provided a planar substrate that forms the base of the transformative scene. One or more panels are fitted within recesses in the substrate. In a first configuration, the panels lie horizontally near or below an upper surface of the substrate with a first surface of the panel substantially co-planar with an upper surface of the substrate. The panels are connected to the substrate by hinges and biased by a spring or other mechanical actuator to move from the first, horizontal configuration, to an upright, second configuration. A latch holds the panels in the first configuration against the bias force of the spring. When the latch is actuated, the panels spring up from the recesses. According to one embodiment this arrangement creates the illusion of a construction site transformed into a finished building or a building in summertime transformed into the same building in wintertime decorated for a holiday.

According to another embodiment, a plurality of panels are provided in respective recesses in the surface of the substrate that include extension features that extend vertically when the panels are in the horizontal first position. These extension features may be decorated to form an element of a first scene, for example, a fence disposed around a construction site. When latching mechanisms holding the panels in the first configuration are released, the panels spring into the second configuration with the extension features positioned to contact one another. The extension features may include decorative elements designed to appear as the roof or a wall of the completed building when the scene is transformed into the second configuration.

According to a still further embodiment, the mechanism for actuating the plurality of panels does so according to a predetermined sequence. Such a sequence can be arranged so that panels forming the side walls and roof of a building the second scene are actuated first to create a space to receive the panel forming the façade of the building so that the roof is formed before the façade snaps into place beneath the roof.

According to some embodiments of the disclosure, each panel is connected with the substrate by a hinge arranged along an edge of the recess holding the panel in the first configuration. A spring or other biasing mechanism is provided to rotate the panel about the hinge. A latch mechanism engages the panel to hold it against the force of the spring. The latch mechanism may be a pin slidably fixed with the substrate and arranged to extend into a hole or slot in an edge of the panel. When the pin is pulled away from the panel, the pin disengages from the hole, allowing the panel to swing upward under the force of the spring. The latch mechanism may also be a rotatable arm that can be rotated in one position to engage with a slot on the edge of the panel and rotated to a second position to disengage from the slot, allowing the panel to swing upward under the force of the spring.

A plurality of latches may be provided, each latch engaging a respective one of the plurality of panels. According to some embodiments the latches are each connected with a cable. The cables extend through passages beneath the upper surface of the substrate and are hidden from view. According to some aspects, the passages are provided with pulleys, sheave screws, or other friction-reducing mechanisms that allow the cables to move freely through the passages to communicate a pulling force on the pins.

According to some embodiments, a resilient surface is provided inside one or more of the recesses in the substrate. When the panel is in the first position within the recess, the resilient substrate is compressed below the surface of the substrate. When the panel is released to the second, vertical position, the resilient surface rebounds and expands so that it is coplanar with the surface of the substrate or rises above the surface of the substrate to form an aspect of the second, transformed scene. According to one embodiment, the resilient surface is formed by a rigid plate fitted into the recess and movable vertically. Below the plate, within the recess are one or more elastomer blocks that support the plate. When the panel is in its horizontal position, the panel pressed downward on the plate, compressing the elastomer blocks. When the panel is release, the elastomer blocks rebound, forcing the plate upward toward the surface of the substrate.

According to a further aspect, the cables from the plurality of pins are connected with a latch operating mechanism. When the latch operating mechanism is actuated, tension is applied to the cables to disengage the pins from the panels, allowing the panels to swing upward from the substrate. According to another aspect, the length of the cables is selected so that certain of the panels are actuated before others of the panels. According to this aspect, one or more of the cables has a selected amount of slack relative to others of the cables to provide a predetermined sequence of actuations of the panels. The latch operating mechanism may be a servomotor.

According to another embodiment of the disclosure, in addition to a plurality of panels releasably positioned in recesses in a substrate, a fixed structure is provided. The fixed structure may be a building, such as a house, decorated to represent a first scene, for example, a house during a warm season of the year. The fixed structure is positioned on the substrate with the walls of the structure adjacent the hinged edges of the panels. When the panels are release from the first, horizontal position to the second, vertical position, the panels are positioned adjacent to the walls of the fixed structure, covering the walls of the fixed structure and obscuring the elements representing the first scene. In the second, vertical position, the second surfaces of the panels are now positioned outward from the fixed structure. As with the previous embodiments, the second surfaces of the panels are decorated to represent the second scene, for example, a house in winter.

According to another embodiment of the disclosure the fixed structure is a miniature model of a building such as a peaked roof house with a portion of the roof including a rotatable section. When the rotatable section is in a first position, the upper surface is aligned with the remainder of the roof. This upper surface may be decorated to represent aspects of a first decorative scene, for example, a bare shingled roof surface that might indicate a warm season of the year. When the rotatable section is rotated, a second upper surface is aligned with the remainder of the roof. This second upper surface may be decorated to represent a second decorative scene, for example, a roof covered with snow to indicate a winter season. Fanciful figures such as Santa Claus in a sled with reindeer may extend from the second upper surface to indicate a holiday season. The rotation of the roof section may be synchronous with other transformative aspects, such as the actuation of wall panels.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1A:
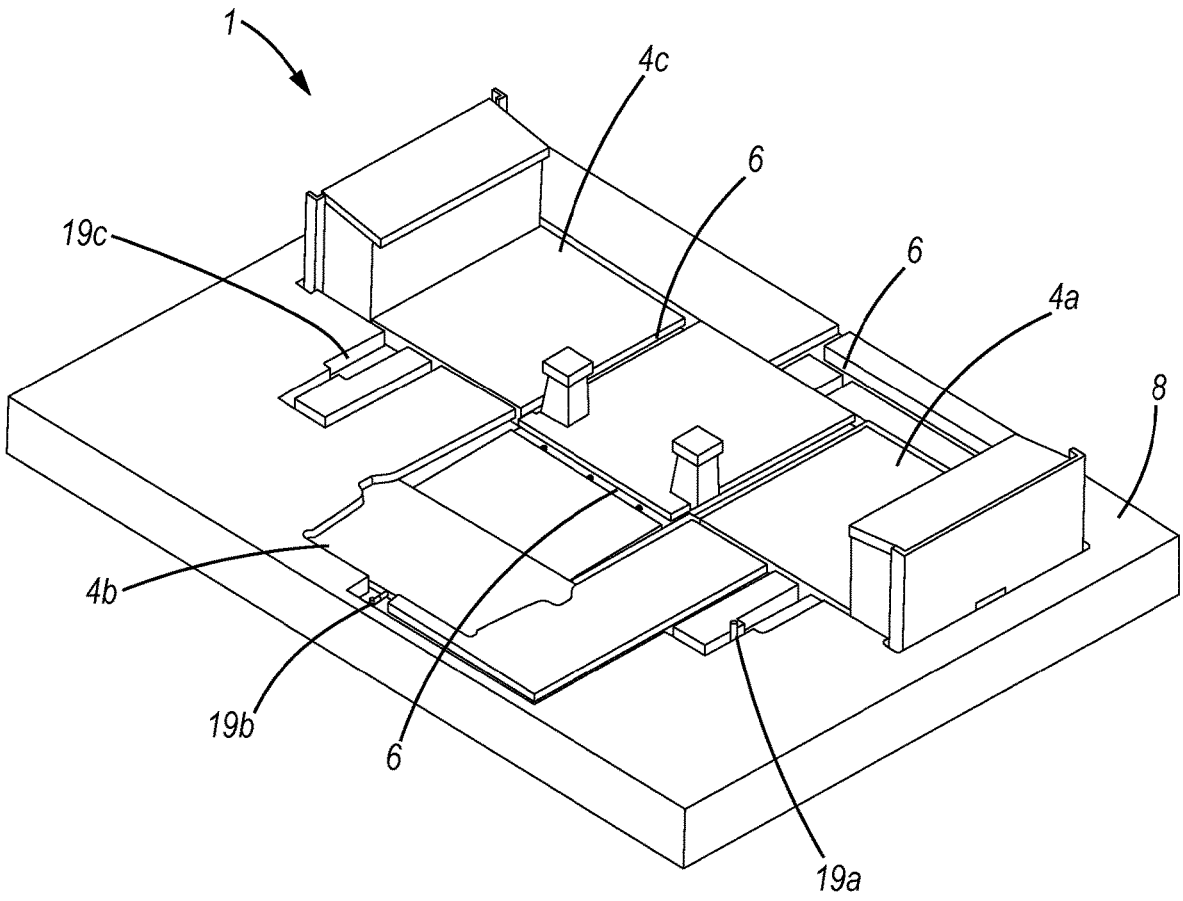
FIGS. 1A and 1B are perspective views of a transformative display scene according to an embodiment of the disclosure with FIG. 1A showing a first scene before the transformation and FIG. 1B showing a second scene after the transformation.
Figure 1B:
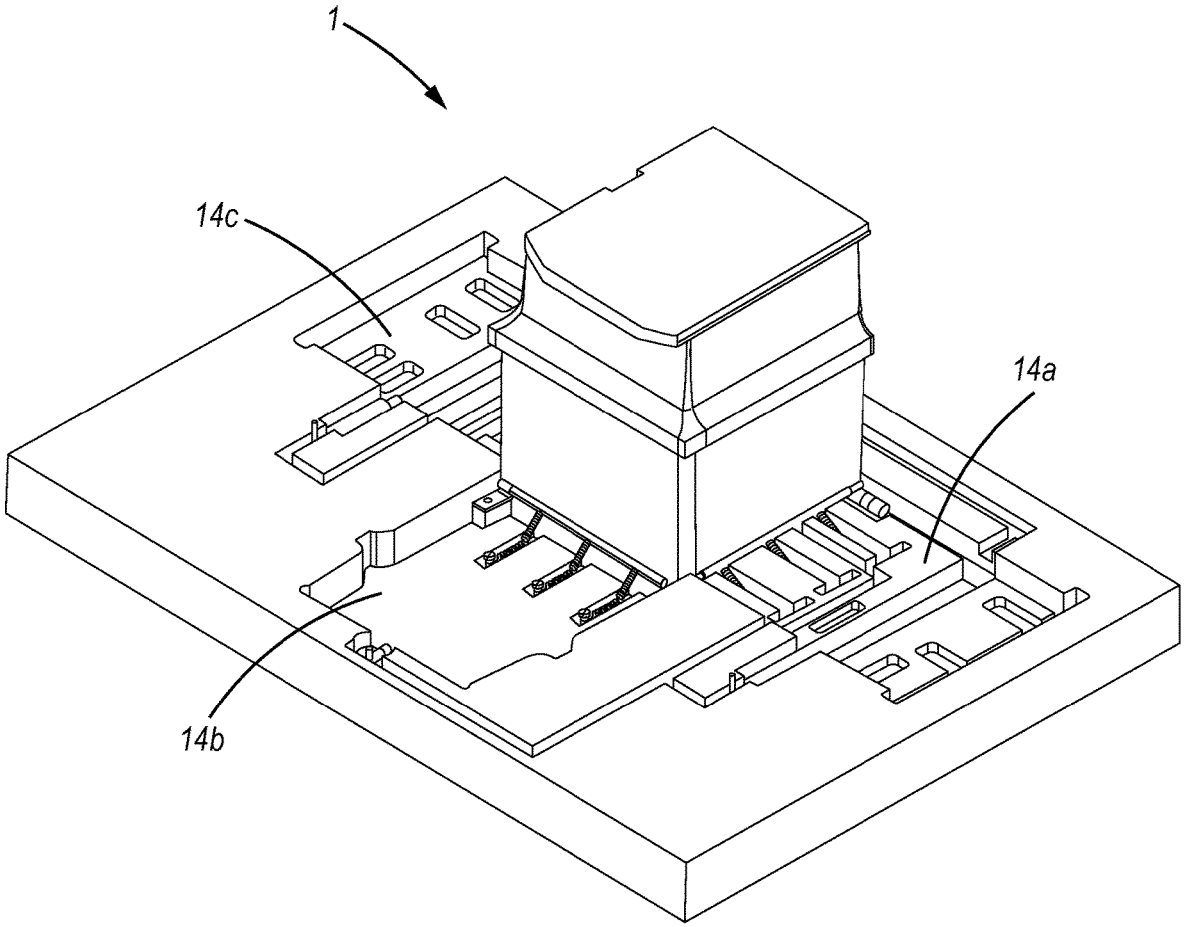

FIGS. 1A and 1B show a transformative display 1 according to one embodiment of the disclosure. A number of panels 4*a*, 4*b*, 4*c* are connected with a platform 8 by hinges 6. Each panel fits into a respective recess 14*a*, 14*b*, 14*c* formed in the platform 8. The recesses 14*a*, 14*b*, 14*c* are shaped to conform to the outline of the panels and are deep enough so that, when the panels are in a first configuration, the panels sit below an upper surface of platform 8.

Figure 2A:
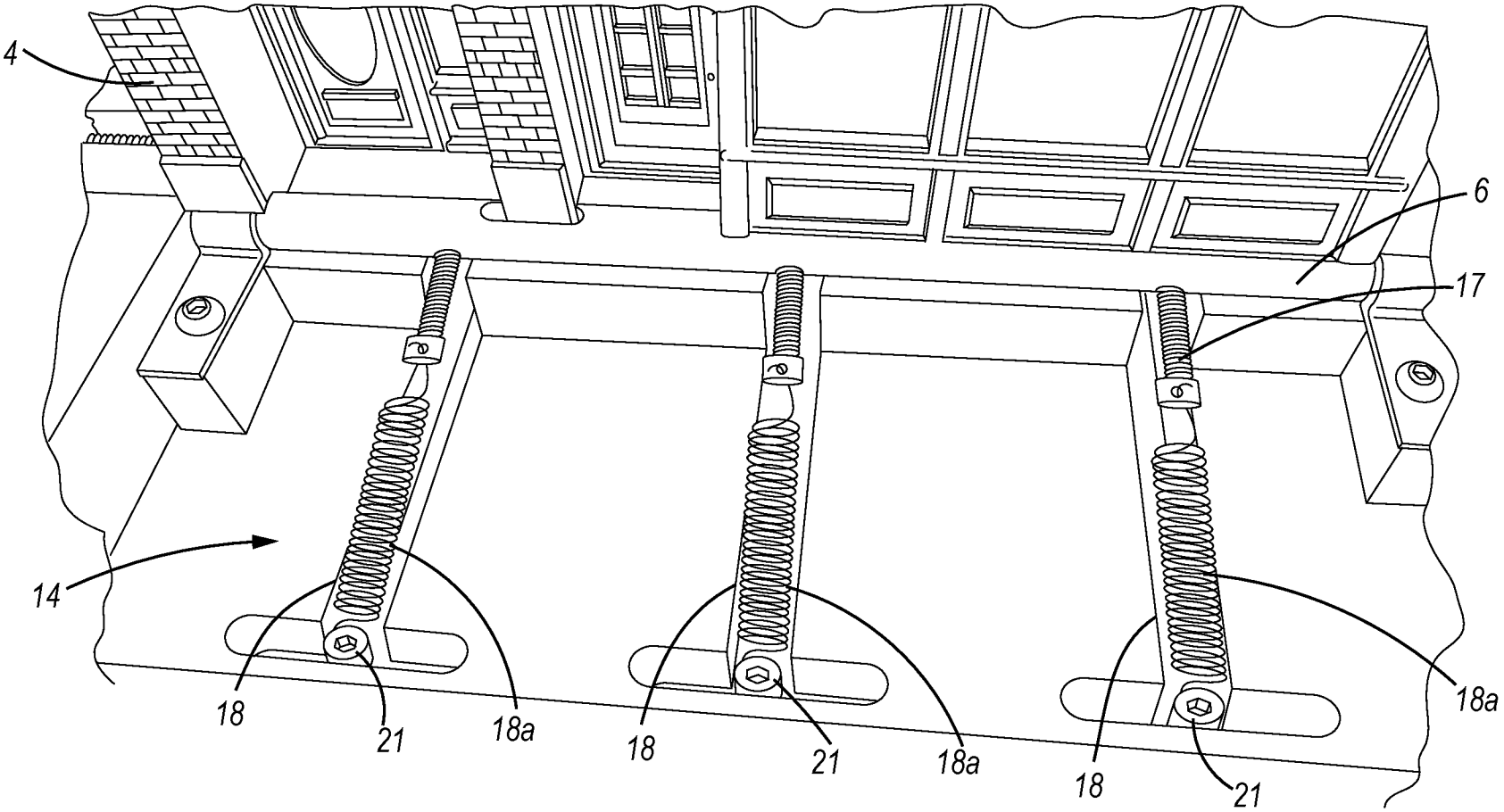
FIGS. 2A and 2B are perspective views of a biasing mechanism of the embodiment of FIGS. 1A and 1B.

Hinges 6 are provided along an edge of each panel and connect the panel to an edge of the respective recess 14*a*, 14*b*, 14*c*. According to one embodiment, hinge 6 is a barrel hinge that extends substantially along the length of the edge of the panel. According to other embodiments, hinge 6 is comprised of a plurality of separate hinges disposed along the length of the edge of the panel. According to a still further embodiment, hinge 6 is formed by one or more membrane hinges that connect panel 4 and platform 8. FIG. 2A shows a detailed view of one of the panels 4 connected to platform 8 by hinge 6.

Below the recess 14 (that is, one of the recesses 14*a*, 14*b*, 14*c*), one or more spring cavities 18 are provided. FIG. 2A shows a detailed view of a panel with three such spring cavities 18. According to this embodiment, spring cavities

Figure 2B:
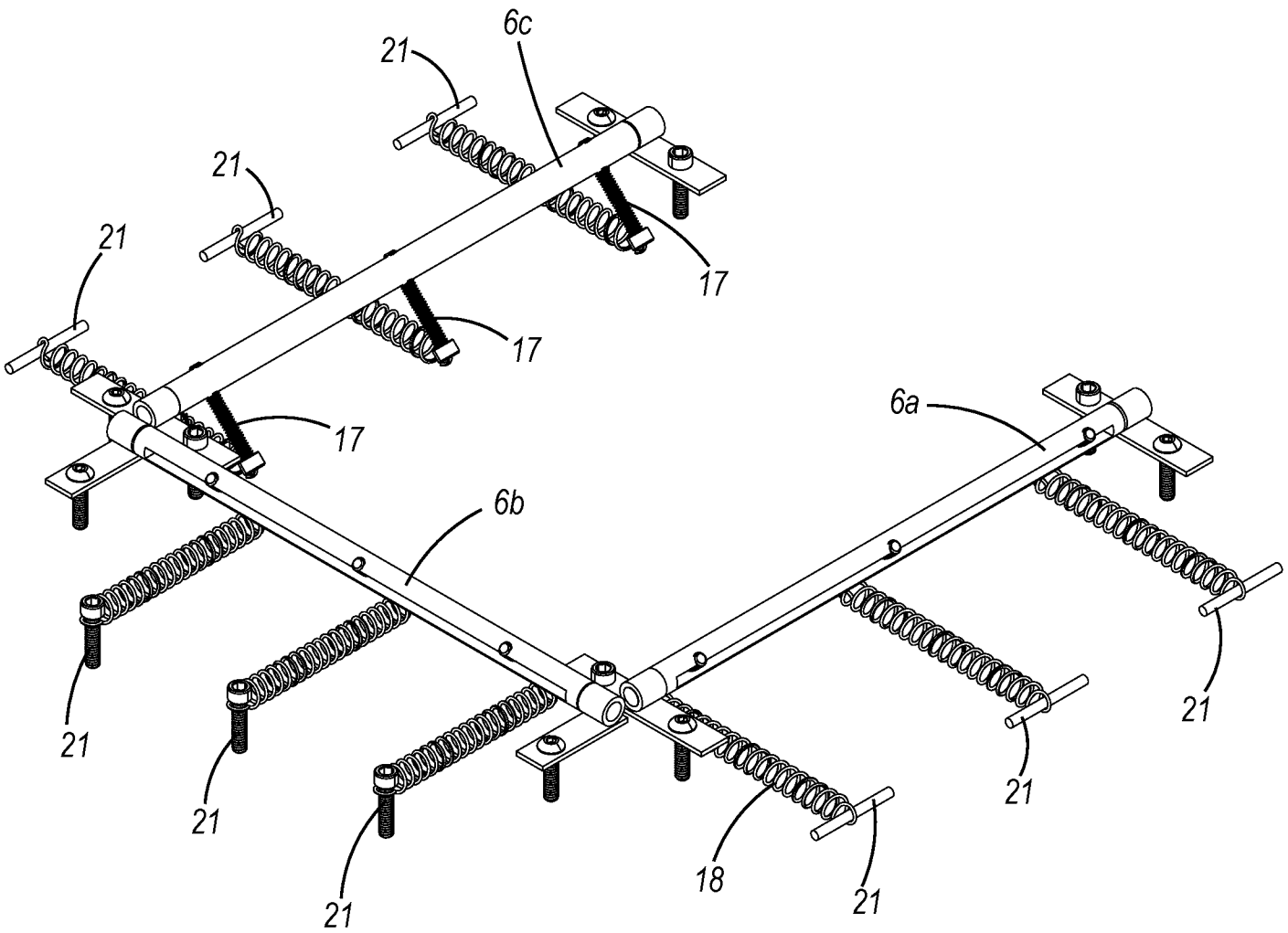

18 each accommodate a coil spring 18*a*. FIG. 2B shows a detailed view of three barrel hinges 6*a*, 6*b*, 6*c* that connect respective panels 4*a*, 4*b*, 4*c* with platform 8. As shown in FIG. 2A, one end of the spring is connected to a fixed point 21 at an end of the cavity, such as, a bolt or screw. The opposite end of spring 18*a* is connected with a lever arm 17. Lever arms 17 are connected with each respective panel 4 (i.e., panels 4*a, b, c*). Sufficient clearance is provided in the spring cavity 18 to allow the lever arm to swing through an arc so that, when spring 18*a* pulls the end of arm 17 toward fixed point 21, the motion of the arm 17 causes panel 4 (that is, any one of panels 4*a*, 4*b*, 4*c*) to rotate about the axis of hinge 6 to move the panel 4 out of cavity 14 and into an upright position.

As shown in FIG. 1A, latches 19*a*, 19*b*, 19*c* are disposed below the surface 8 of the platform. Latches 19*a*, 19*b*, 19*c* engage with respective holes on the edges of panels 4*a*, 4*b*, 4*c*. In the configuration shown in FIG. 1A, latches 19*a*, 19*b*, and 19*c* engage with panels 4*a*, 4*b*, 4*c* to retain the panels in the respective cavities 14*a*, 14*b*, 14*c* in platform 8. When the latches are actuated, as will be explained below, the panels are driven by springs 18*a* to swing into the upright position.

Figure 3A:
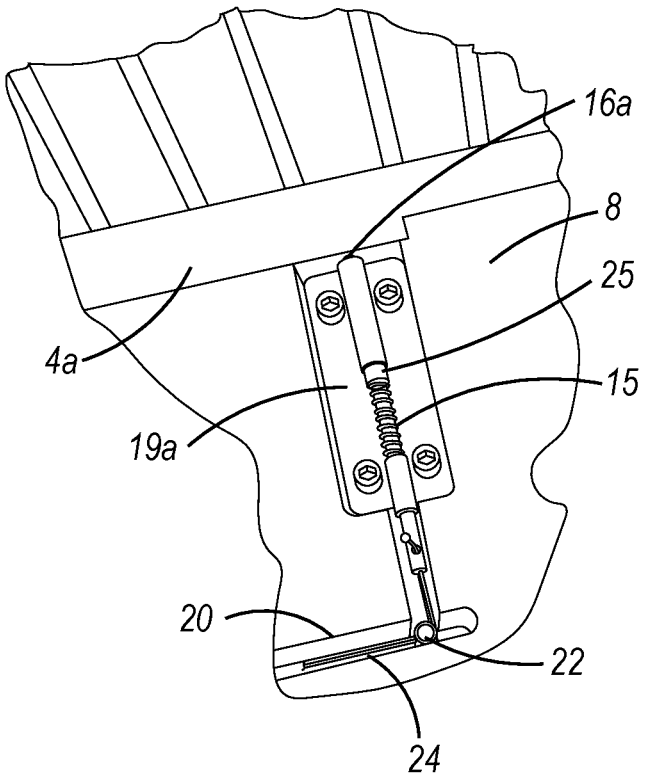
FIGS. 3A and 3B are perspective views of a latching mechanism of the embodiment of FIGS. 1A and 1B.
Figure 3B:
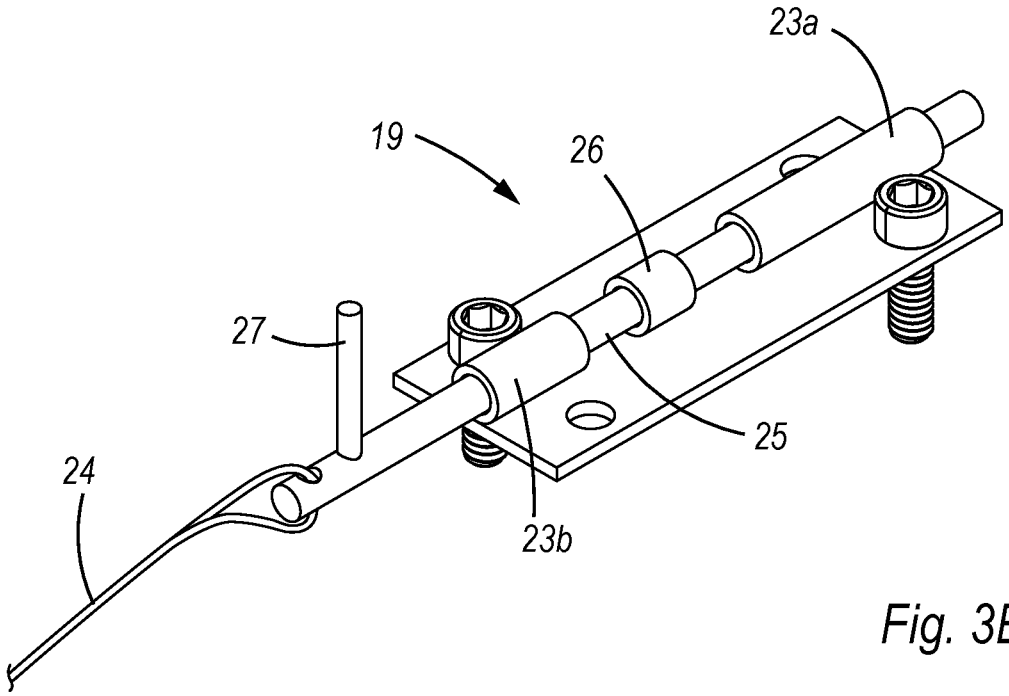

FIG. 3A shows a detailed view of latch 19*a* engaged with hole 16*a* in panel 4*a*. FIG. 3B shows a detailed view of one of the latches 19. According to one embodiment, latch 19 is comprised of a shaft 25 that slides through supports 23*a* and 23*b*. When moved outward from support 23*a*, shaft 25 engages with a hole along the edge of a panel, such as hole 16*a* in panel 4*a*. According to some embodiments, such as the one shown in FIG. 3A, a spring 15 is provided to drive shaft 25 toward the hole to keep the end of shaft 25 engaged with the hole. According to other embodiment, such as shown in FIG. 3B, no spring is provided. The opposite end of shaft 25 is connected with control cable 24. According to this embodiment, cable 24 is positioned within slot 20 recessed into the surface of platform 8. One or more guides 22 may be provided to facilitate the smooth movement of cable 24. The guides 22 may be formed by smooth sided shafts or sheave screws that allow the cable to slide smoothly around corners of slot 20. According to other embodiments, guides 22 are formed by pulleys.

When tension is applied to cable 24, shaft 25 is pulled away from the edge of the respective panel. This disengages shaft 25 from the hole in the edge of the panel. When shaft 25 disengages from hole 16*a*, the bias force applied by springs 18*a* causes panel 4*a* to rotate about the axis of hinge 6 and move to the upright configuration.

As shown in the embodiment of FIG. 3B, latch 19 includes a reset handle 27 connected with shaft 25. To reset panel 4*a* back to the horizontal position, the panel is pushed back into recess 14*a* in platform 8 against the tension of springs 18*a*. Handle 27 is used to push shaft 25 back into engagement with the hole 16*a* in the edge of the panel.

According to the embodiment of FIG. 3B, latch 19 includes a stopper 26 positioned between supports 23*a* and 23*b*. Stopper 26 limits the travel of shaft 25 so that it remains captive between the supports.

Figure 4A:
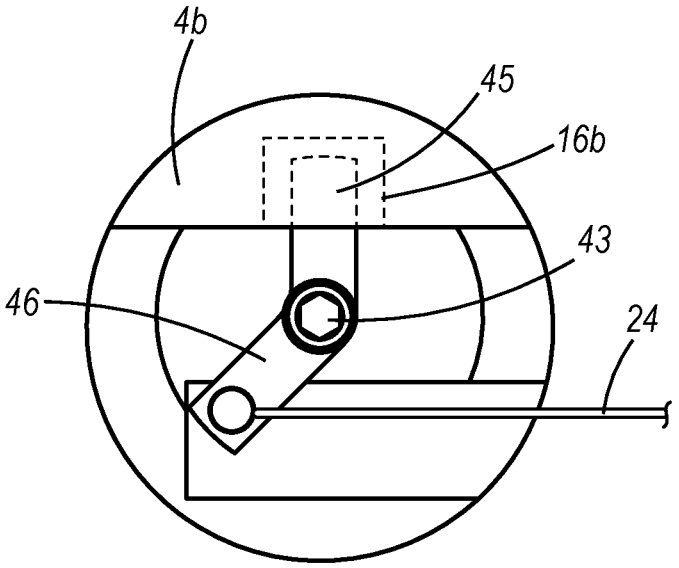
FIGS. 4A, 4B, and 4C are a top view, a side view, and a bottom view, respectively, of another latching mechanism of the embodiment of FIGS. 1A and 1B.
Figure 4B:
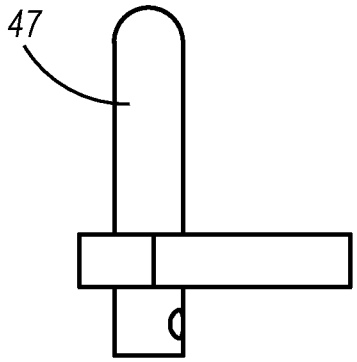
Figure 4C:
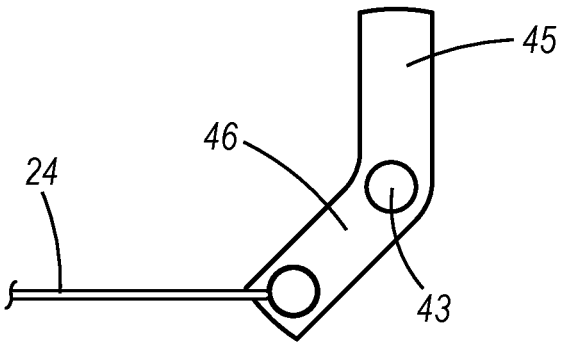

FIGS. 4A, 4B, and 4C show a latch 19 according to another embodiment of the disclosure. Latch arm 45 extends from fulcrum 43. Actuator arm 46 extends from fulcrum 43 opposite from latch arm 45. Arms 45 and 46 can rotate about fulcrum 43. Cable 24, as described in the previous embodiments is connected with actuator arm 46. Tension applied to cable 24 causes actuator arm 46, and hence, latch arm 45 to rotate about fulcrum 43. In the configuration shown in FIG. 4A, latch arm 45 engages with a slot in the edge of a panel, such as panel 4*b* to hold the panel in the horizontal position against the tension of springs 18*a*. When latch arm 45 is rotated by tension applied by cable 24, latch arm rotates away from the edge of the panel. In this embodiment, a slot 16*b* is formed in the edge of the panel instead of a hole. Rotation of latch arm 45 disengages the arm 45 from the slot and allowing the panel 4*b* to move into the upright position under the force applied by the springs. Reset handle 47 extends upward from actuation arm 46. To reset panel 4*b* in the horizontal position, the panel is pressed into recess 14*b* and handle 47 is used to rotate latch arm 45 into engagement with the slot 16*b* in the edge of the panel 4*b*.

Figure 5:
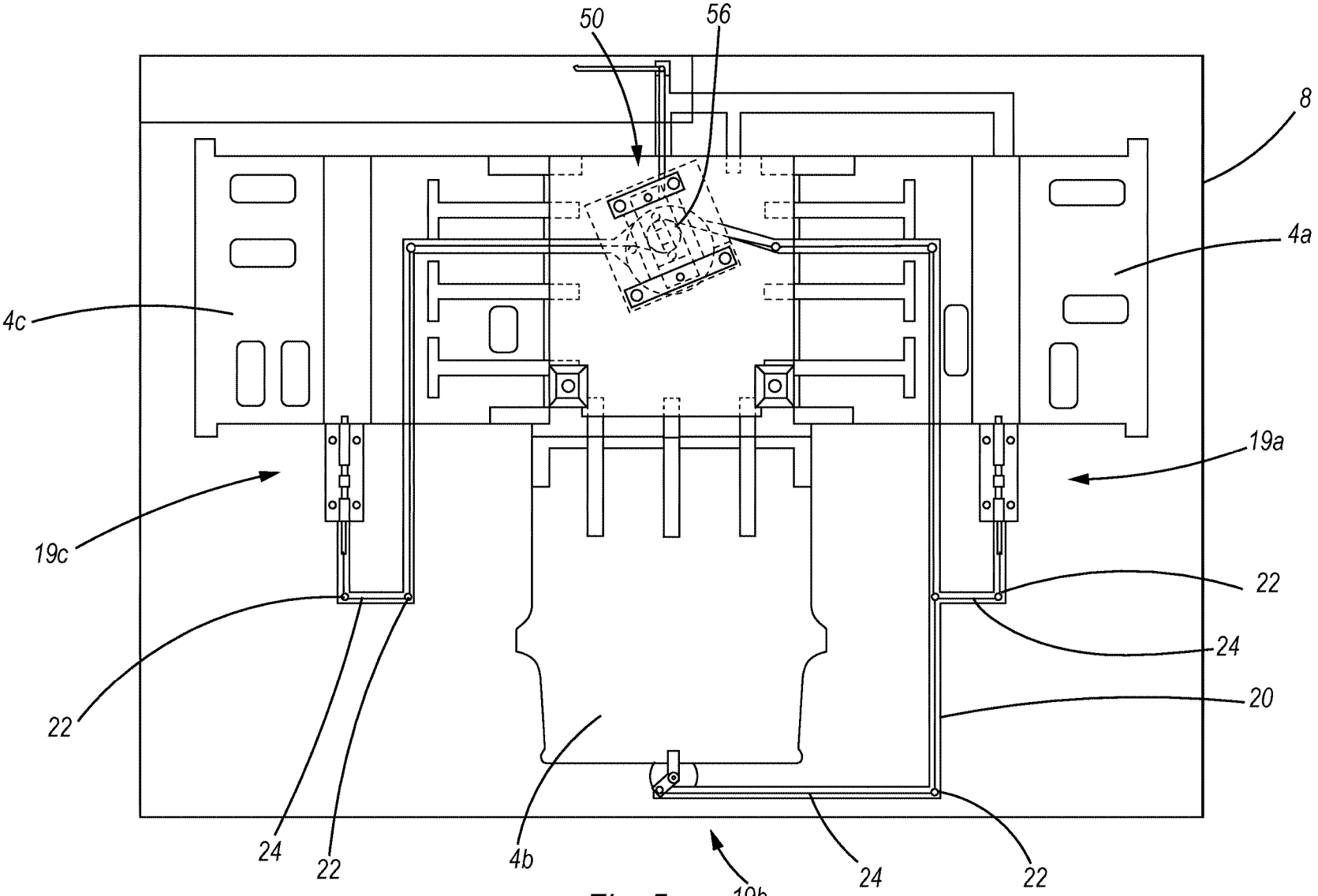
FIG. 5 is a top view of a transformative display according to another embodiment of the disclosure illustrating a system of cables for actuating panels to transform a first scene into a second scene.

FIG. 5 shows a top view of a display according to an embodiment of the disclosure. Panels 4*a*, 4*b*, 4*c* are held down into recesses in platform 8 by latches 19*a*, 19*b*, 19*c*, respectively. Cables 24 are connected with the latches. The cables travel through slots 20 in the surface of platform 8. Cable guides 22, for example, sheave screws are provided at corners of slots 20 to allow the cable to move smoothly. Cables 20 are connected with capstan 56 of servo motor 50.

Figure 6:
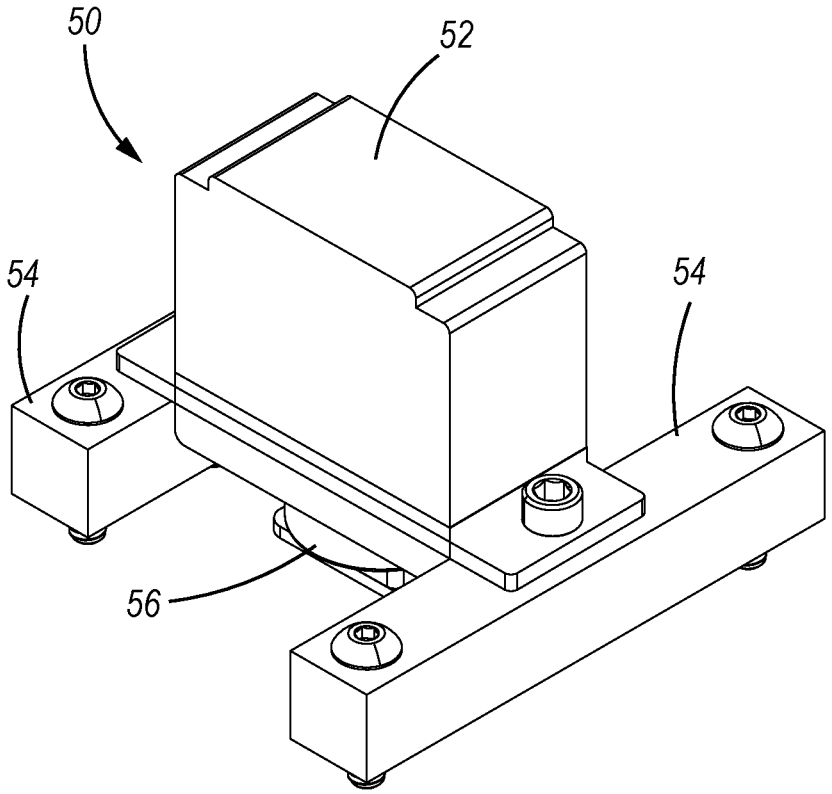
FIG. 6 is a perspective view of a servomotor assembly for operating the display according to the embodiment of FIG. 5.

FIG. 6 shows a detailed view of servo motor assembly 50. Servomotor 52 is supported by supports 54 with capstan 56 positioned below the motor. In the embodiment shown in FIGS. 5 and 6, supports 54 are sized so that capstan 56 is coplanar with slots 20. Cables 24 are connected with capstan 56 so that, when motor 52 is energized, cables 56 are pulled by rotation of capstan 56 along slots 20 and away from latches 19*a*, 19*b*, 19*c*. Tension applied to the latches causes them to disengage from panels 4*a*, 4*b*, 4*c*.

According to one embodiment, rotation of capstan 56 applies tension simultaneously on all of cables 24, causing all of the panels 4*a*, 4*b*, 4*c* to be actuated at the same time. According to another embodiment, one or more of cables 24 has slack relative to others of the cables. According to this embodiment, latches connected with cables including slack are actuated slightly later in time as compared with latches operated by cables without slack. This causes the respective panels to be actuated in a predetermined sequence. Such an arrangement allows certain of the panels to reach the full upright position before others. This would allow some portions of the model to be in position to receive engaging features of other portions of the model.

According to other embodiments, instead of a single servomotor 50 connected with all of the cables 24, a plurality of servomotors may be used, each connected to one or more of the cables. This arrangement allows the servomotors to be energized separately, for example, under the control of a computer program, to actuate panels 4*a*, 4*b*, 4*c* according to a programmable sequence. According to other embodiments, instead of a servomotor, cables 24 can be pulled using a pneumatic or hydraulic actuator. According to other embodiment, cables are pulled using a hand-operated lever.

Figure 7A:
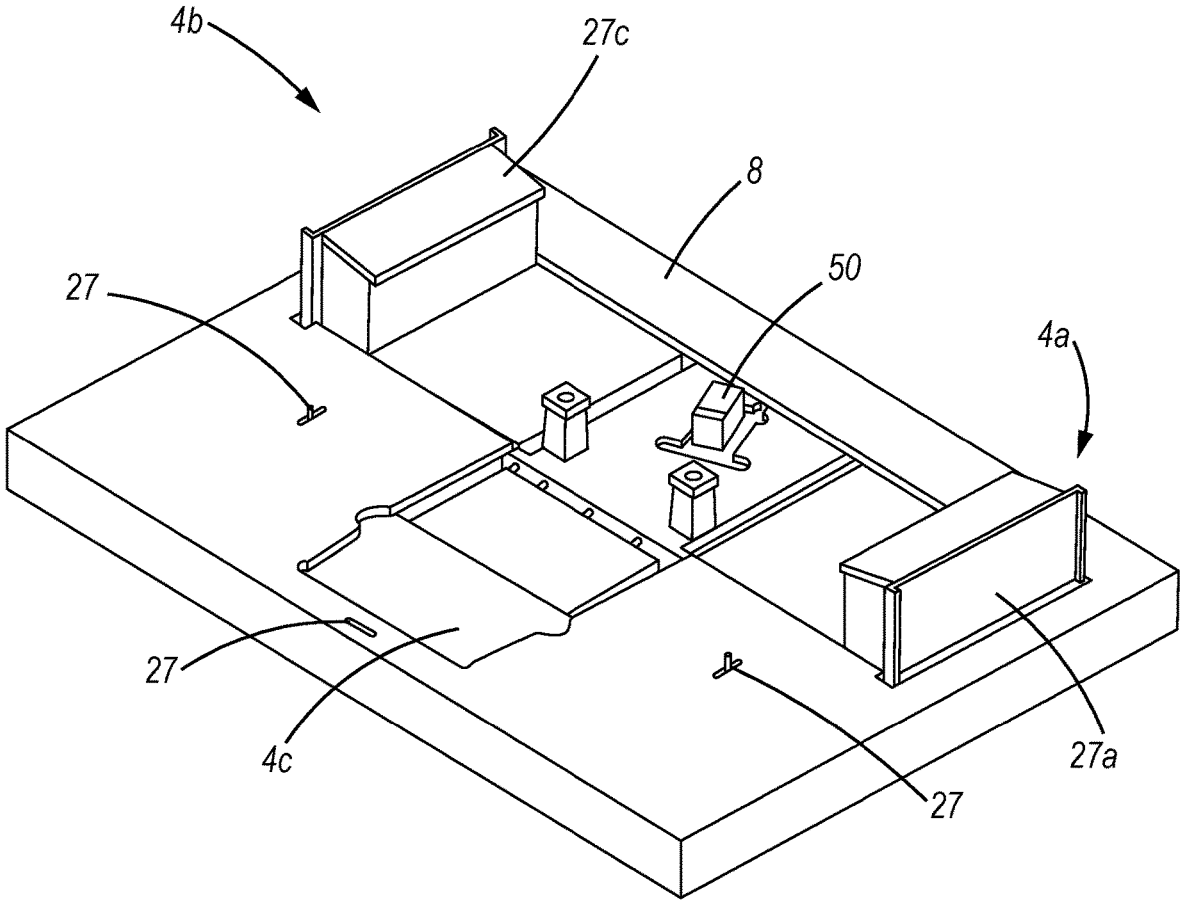
FIGS. 7A and 7B are perspective views of a transformative display according to a further embodiment of the disclosure, with FIG. 7A showing a first scene before a transformation and with FIG. 7B showing a second scene after the transformation.
Figure 7B:
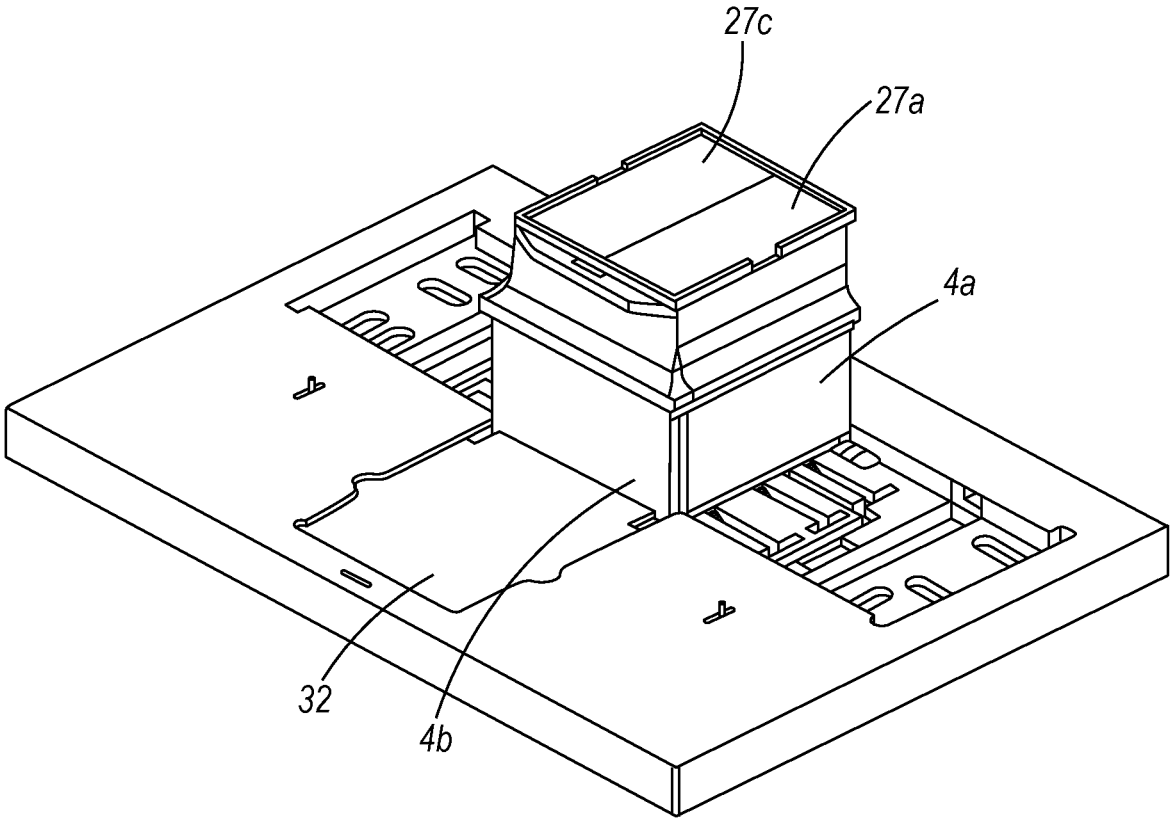

FIGS. 7A and 7B show a transformative scene according to an embodiment of the disclosure. In FIG. 7A, panels 4*a*, 4*b*, 4*c* are in the horizontal position. Certain of the panels may include features that have one appearance when the panels are positioned horizontally within the recesses and another appearance when the panels are positioned vertically. In FIG. 7A, panels 4*a* and 4*c* include features 27*a* and 27*c*, respectively, that extend perpendicularly from the upper surface of the horizontal panel. These vertical features may be decorated to appear as structures of a first scene. For example, the scene in FIG. 7A might be decorated with visual elements designed to represent a graveyard with elements 27*a* and 27*c* being mausoleums.

FIG. 7B shows the model after the panels have been actuated. Panels 4*a* and 4*c* form side walls of a building.

Vertical features 27*a*, 27*c* are shaped to contact one another when the panels are positioned vertically to provide a roof for the building. Panel 4*b* forms the façade of the building.

In the embodiment of FIGS. 7A and 7B, a resilient floor 32 is provided in the cavity 14*b* that holds panel 4*b*. This resilient floor 32 may be formed by providing a rigid panel fitted into the cavity 14*b* in the substrate 8 that can move up and down within the cavity. The rigid panel is supported by one or more blocks of an elastomeric material, such as a foam, or a rubber. When panel 4*b* is in the horizontal position, shown in FIG. 7A, floor 32 is compressed beneath the panel. When panel 4*b* is actuated, floor 32 expands upward, as shown in FIG. 7B. According to some embodiments, the top surface of floor 32 expands to be co-planar with platform 8.

As discussed above, by selecting the lengths of cables 24 connected with latches 19*a*, 19*b*, 19*c*, the sequence of the actuation of the panels relative to one another can be selected. For example, in the example shown in FIGS. 7A and 7B, panels 4*a*, 4*c* forming sidewalls can be actuated before panel 4*b* forming the façade so that the sidewalls and roof of the model building are formed before the façade swings into place.

Figure 8A:
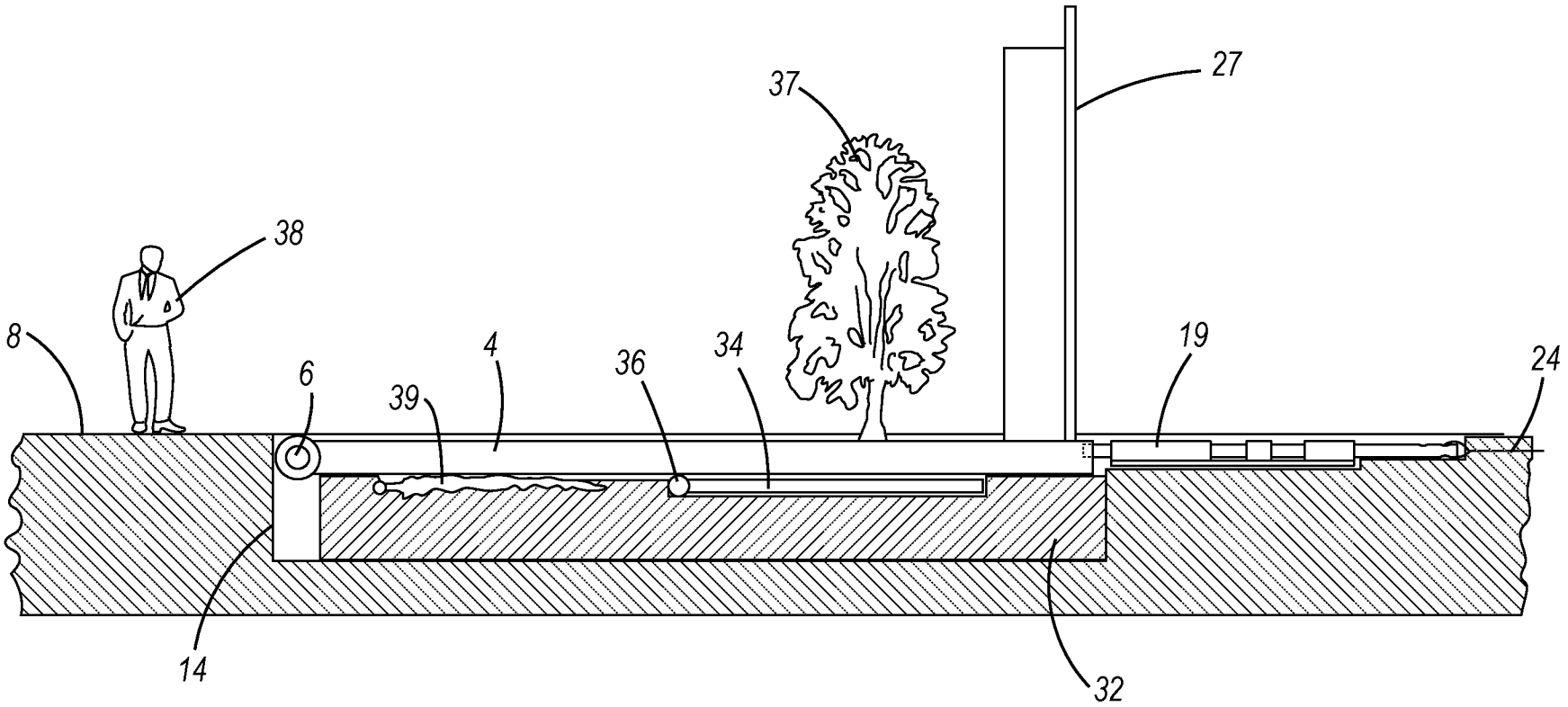
FIGS. 8A and 8B are cross-sectional views of a panel of a transformative display according to a further embodiment of the disclosure, with FIG. 8A showing decorative features of the first scene displayed before a transformation and with FIG. 8B showing decorative features of the second scene displayed after the transformation.
Figure 8B:
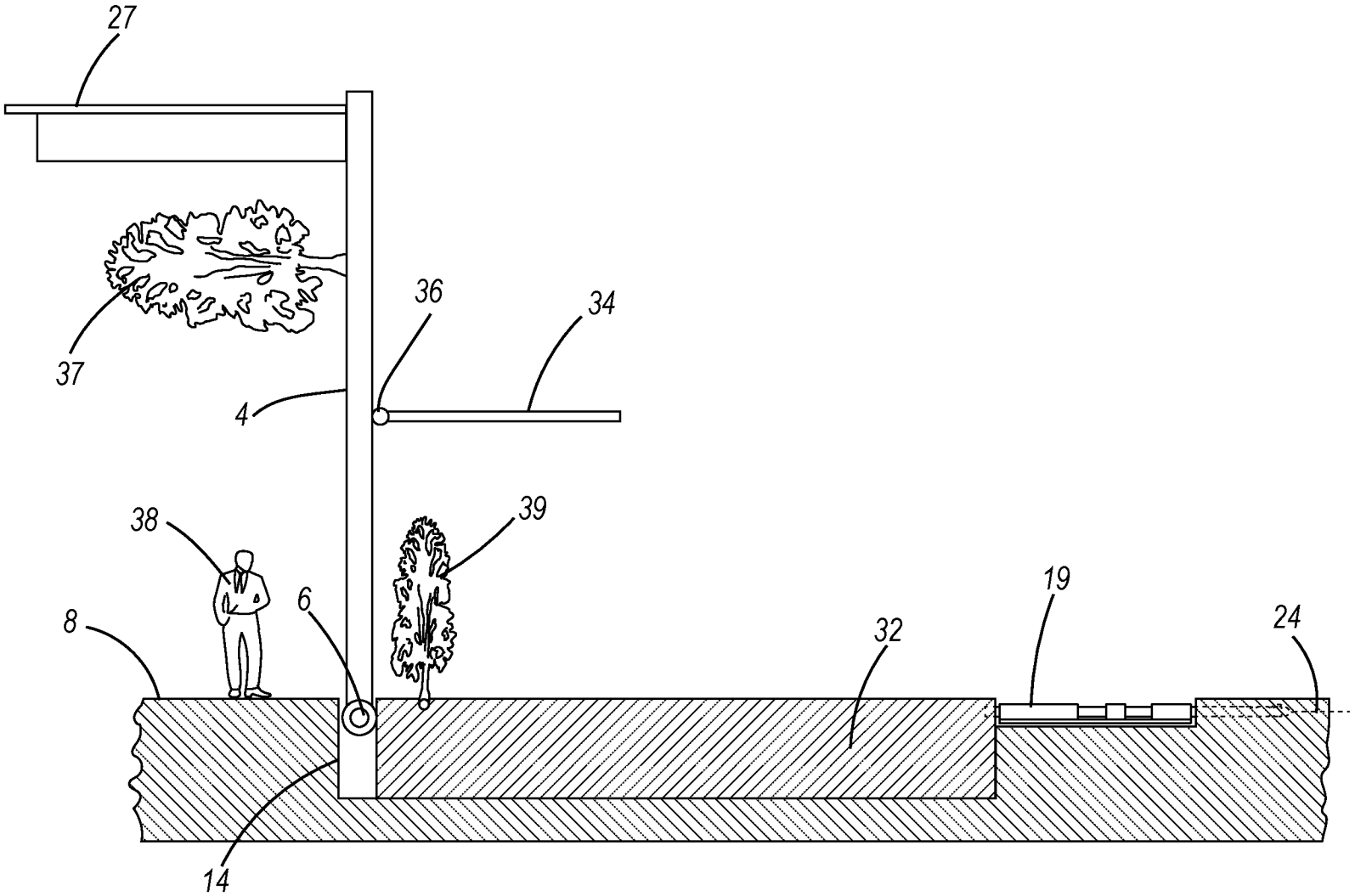

FIGS. 8A and 8B show a further embodiment of the disclosure. FIG. 8A shows a cross section of a portion of platform 8 and recess 14. Panel 4 is in the first configuration, fitted within recess 14. Hinge 6 connects an edge of panel 4 with an edge of recess 14. Springs, not shown in the figure, bias panel 4 toward the upright, second configuration. Latch 19 holds panel 4 within recess 14, as described for the previous embodiments.

As described with previous embodiments, the upward facing surface of panel 4 includes decorative features as part of a first scene depicted by the model. Extension 27 may be provided on the upward facing surface of panel 4. Extension 27 may be decorated to form a feature of the first scene, for example, a fence, a wall, or the like. Other decorative elements 37 may be provided on the upward facing side of panel 4 to create parts of the first scene, for example, trees, human figures, animals, and the like. In addition, features may be provided on platform 8 in the portion between panels 4*a*, 4*b*, 4*c* that are part of the first scene. For example, human figures 38 might be provided.

As sown in the cross-section view of FIG. 8A, a resilient floor 32 may be positioned below panel 4 in recess 14. Panel 4 compresses floor 32 against the bottom surface of recess 14. Floor 32 will expand upward when panel 4 is actuated. The top surface of floor 32 may include decorative features as part of the second scene, as will be described below.

Swinging feature 34 may be connected with the surface of panel 4 by a hinge 36. Hinge 36 may include a spring that biases feature 34 to swing away from the surface of panel 4. In the configuration of FIG. 8A, swinging feature 34 is held against the downward facing surface of panel 4 by floor 32. Swinging feature 34 could form, for example, the awning of a building or a sign on the building once the scene is transformed.

Instead of, or in addition to a resiliently expanding floor 32, other features may be provided beneath the downward facing surface of panel 4 in the configuration of FIG. 8A. For example, features 39 such as trees, human figures, and the like may be formed from compressible materials and connected with the upper surface of floor 32. These figures are obscured in the first scene while panel 4 is held horizontally.

As with the previous embodiments, when tension is applied to cable 24 by servomotor 52, latch 19 disengages from panel 4, allowing panel 4 to swing upward into the second configuration. FIG. 8B shows panel 4 in the second configuration. Resilient floor 32 expands upward when the compression provided by panel 4 is relieved. Portions of the upper surface of floor 32 expand to be above and/or below the upper surface of the platform. Thus, floor 32 forms elements of the second scene, for example, a curb and sidewalk abutting a portion of a street in front of a building in the second scene. Decorative features 39 on the upward facing surface of floor 32 extend upward. Swinging feature 34 swings outward from the surface of panel 4 and may from an element of the second scene, such as a sign or awning extending from a building that is part of the second scene. In the transformed configuration of FIG. 8B, extension 27 extends horizontally and forms another element of the second scene, for example, a portion of the roof of the building. When all of the panels 4*a*, 4*b*, 4*c* are actuated, the form an enclosed structure that obscures decorative features 37, 38 of the first scene.

Figure 9A:
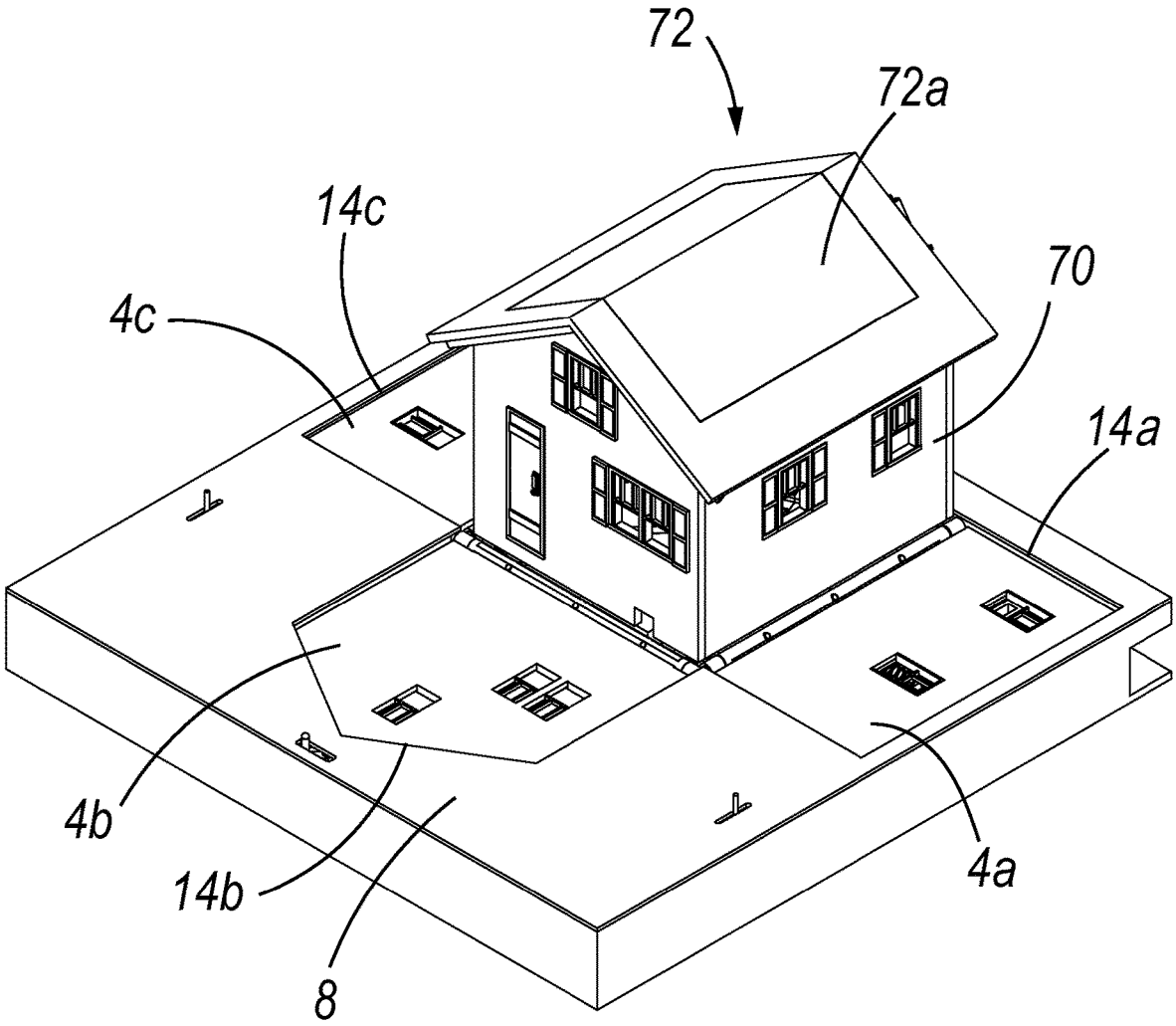
FIGS. 9A and 9B show perspective views of a display according to a further embodiment of the disclosure.
Figure 9B:
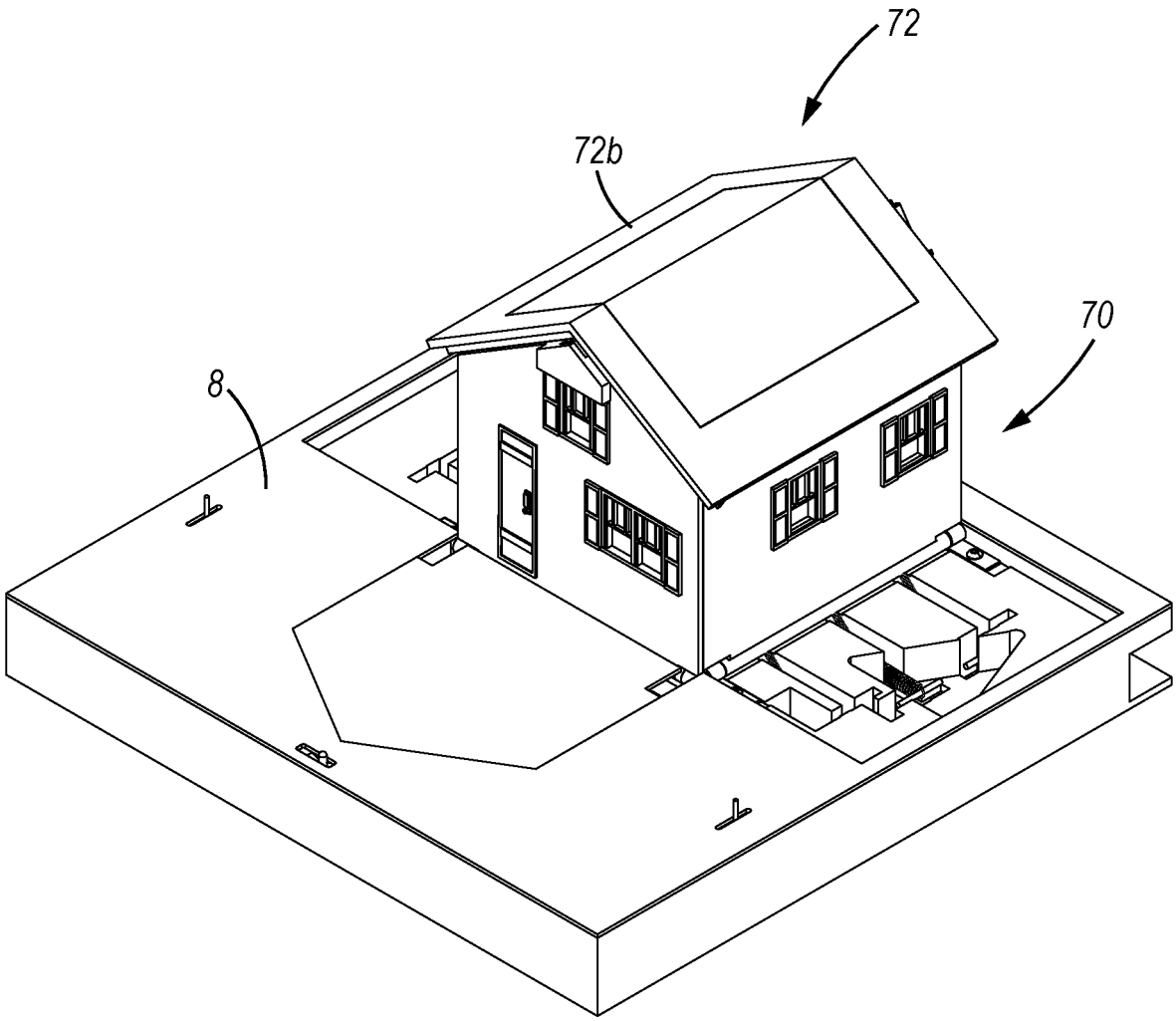

FIGS. 9A and 9B show a transformative scene according to another embodiment of the disclosure. As discussed in the previous embodiments a substrate 8 is provided with one or more cavities 14*a*, 14*b*, 14*c*. In the first configuration, shown in FIG. 9A, spring-loaded panels 4*a*, 4*b*, 4*c* are held in their respective cavities by latches as described in previous embodiments. A fixed structure 70 is provided on substrate 8. According to one embodiment, structure 70 represents a portion of a first scene, for example, a house in a warm season of the year. Edges of structure 70 are aligned with the hinges (not shown in this view) connecting panels 4*a*, 4*b*, 4*c* with substrate 8.

FIG. 9B shows the transformative scene after latches have been actuated to allow panels 4*a*, 4*b*, 4*c* to move to their second, vertical position. The panels now obscure the sides of structure 70. As with previous embodiments, the exposed sides of panels 4*a*, 4*b*, 4*c* show a second scene, for example, a house in winter with portions of the panel decorated with frost and snow. As with the previous embodiments, decorative features representing the second scene may be provided within the cavities that are made visible when the panels swing into the vertical position. These decorative features may include figures formed from a resilient material that spring up when the panels are actuated to represent evocative elements, for example, snow covered trees, snowmen, or human figures in winter clothing.

According to one embodiment, the roof of structure 70 includes a transformative section 72. As shown in FIG. 9A, the transformative section has a first surface 72*a* that forms part of the first scene. In the examples given above, this may be the roof of a house that is free of snow, as a house would be in a warm season.

As shown in FIG. 9B, transformative section 72 has a second surface 72*b* that is exposed, as will be described below, at the same time panels 4*a*, 4*b*, 4*c* are actuated. Second surface 72*b* may be decorated to show additional aspects of the second scene, for example, a snow-covered roof consistent with elements of a winter scene provided on the exposed surfaces of actuated panels 4*a*, 4*b*, 4*c* and resilient features provided within cavities 14*a*, 14*b*, 14*c*.

Figure 10A:
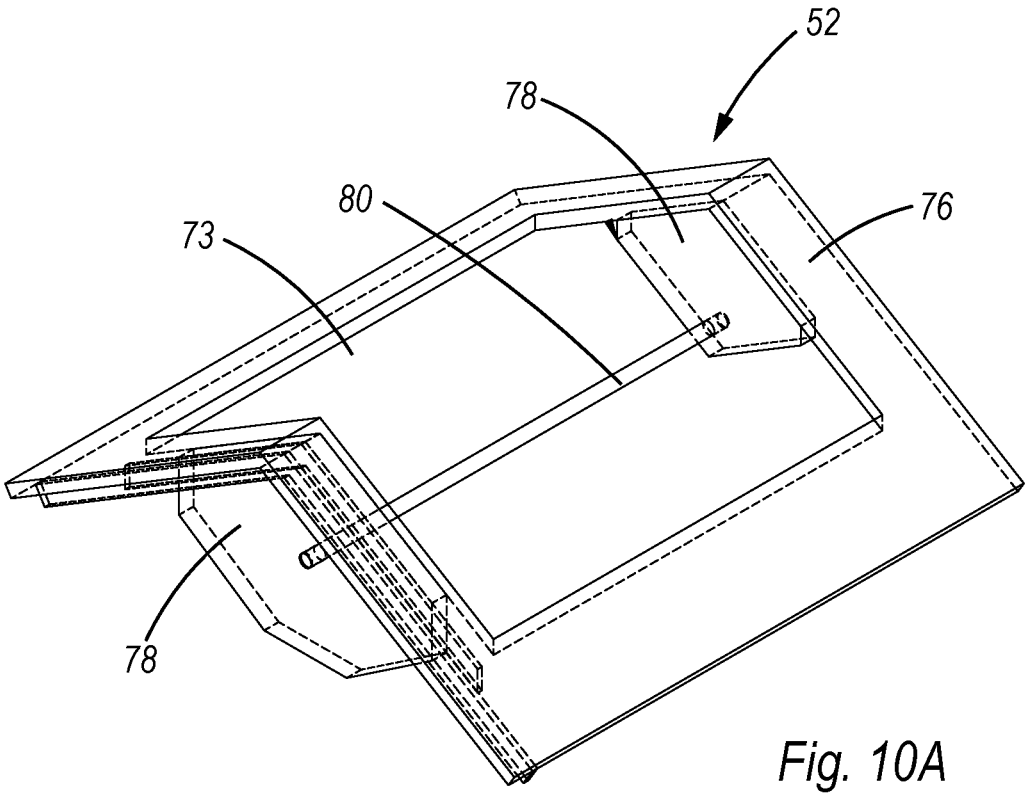
FIGS. 10A, 10B, and 10C show portions of the embodiment of FIGS. 9A and 9B illustrating a roof including a transformative section.
Figure 10B:
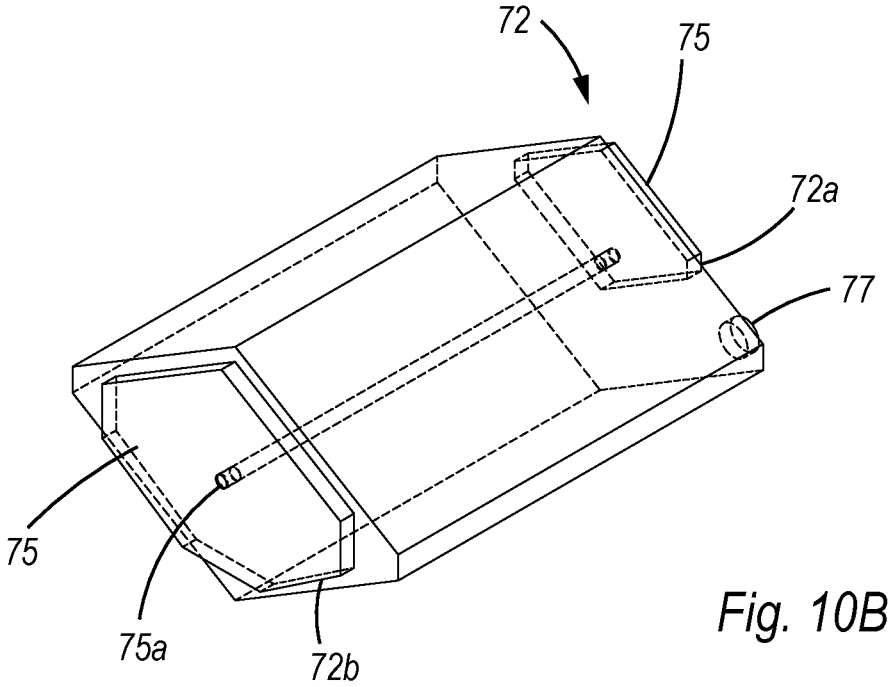
Figure 10C:
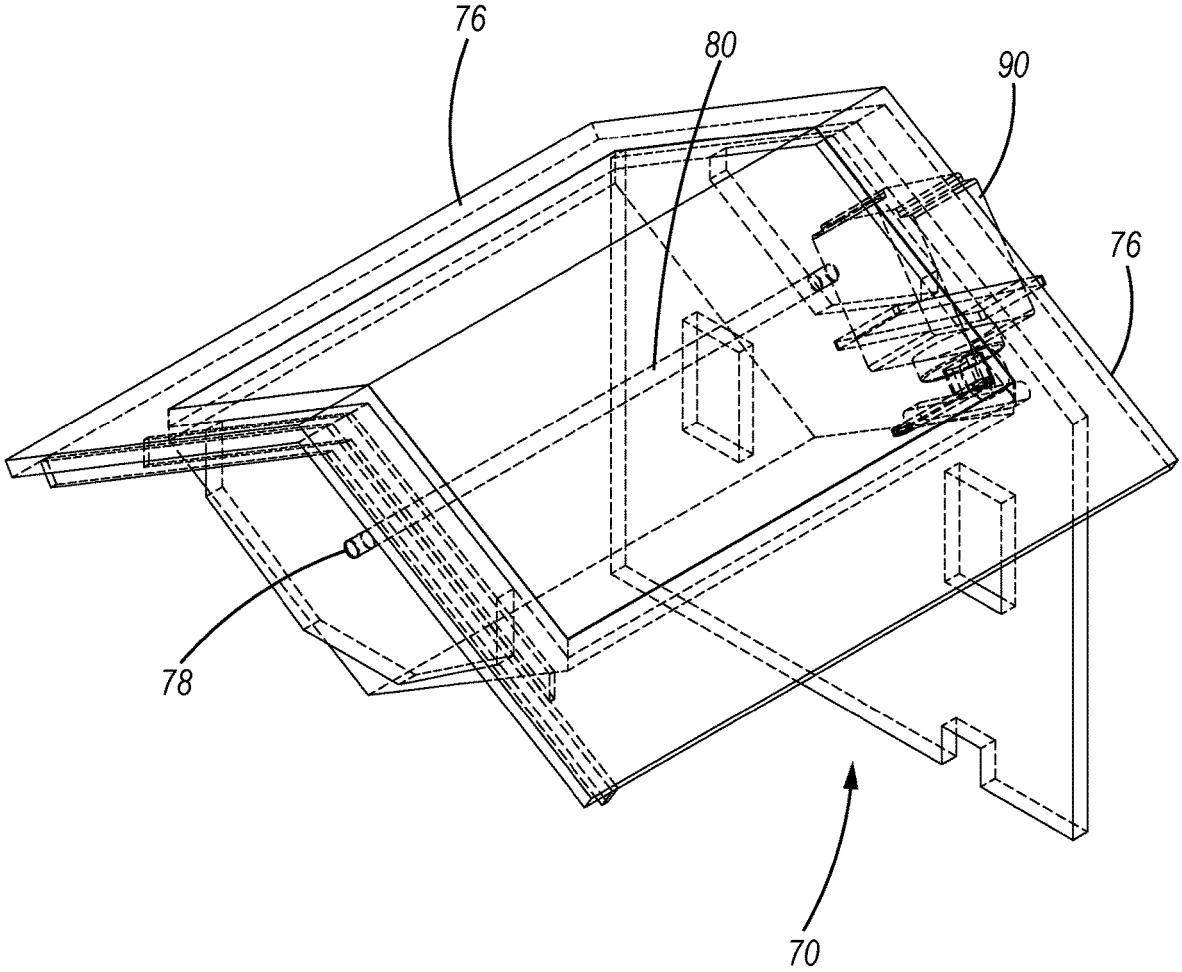

FIGS. 10A-10C show an embodiment of transformative section 72 of the roof in FIGS. 9A and 9B. FIG. 10A shows a portion of structure 70 with transformative section 72 removed. Roof frame 76 surrounds an opening 73 that will fit the transformative section 72. Roof frame 76 is connected with the walls of structure 70. End plates 78 are connected with roof frame 76 on either end of opening 73. Support rod 80 extends between end plates 78. FIG. 10B shows transformative section 72 separate from structure 70. Keeper plates 75 are provided on either end of section 72. First surface 72*a* and second surface 72*b* extend between keeper plates 75. Each keeper plate 75 includes a pivot hole 75*a*. FIG. 10C is a partial view of structure 70. Roof frame 76 is connected with and supported by the walls of structure 70. Rod 80 extends between end plates 78 and passes through pivot holes 75*a* in keeper plates 75. Materials forming rod 80 and keeper plates 75 are selected to provide low friction so transformative section 72 rotates freely around rod 80. According to one embodiment, a weight (not shown) is provided on an inner face of first surface 72*a* so that, when transformative section 72 is allowed to rotate, the first surface will be position downward, so that it is inside of structure 70 and obscured and second surface 72*b* will face upward and be aligned with roof frame 76 to form the exposed roof of the second scene (e.g., of a house in winter). A stop block 77 is provided on one or both of the keeper plates 78. The size and location of stop block 77 is selected so that, when the transformative section rotates so that second surface 72*b* is upward and aligned with roof frame 76, further rotation is prevented.

Figure 11A:
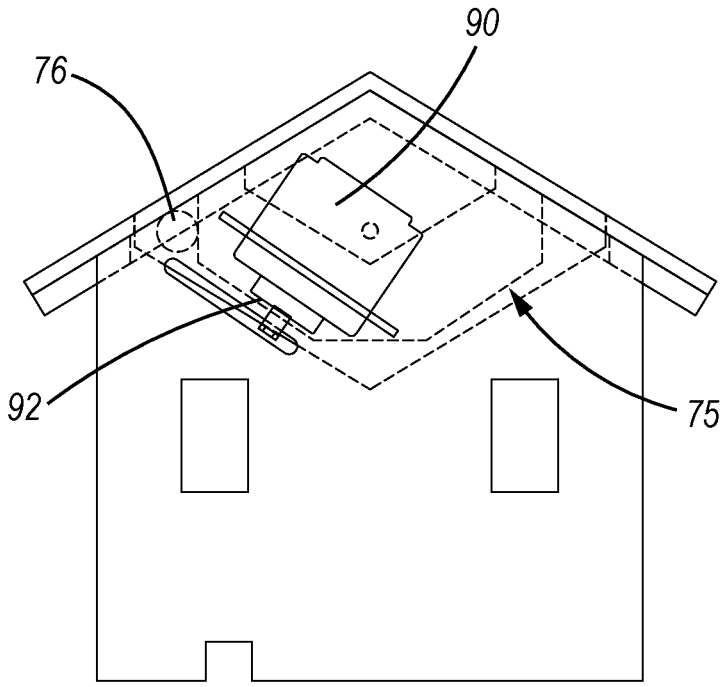
FIGS. 11A, 11B, and 11C show portions of the embodiment of FIGS. 9A and 9B illustrating a servomotor assemble for actuating the transformative roof section.
Figure 11B:
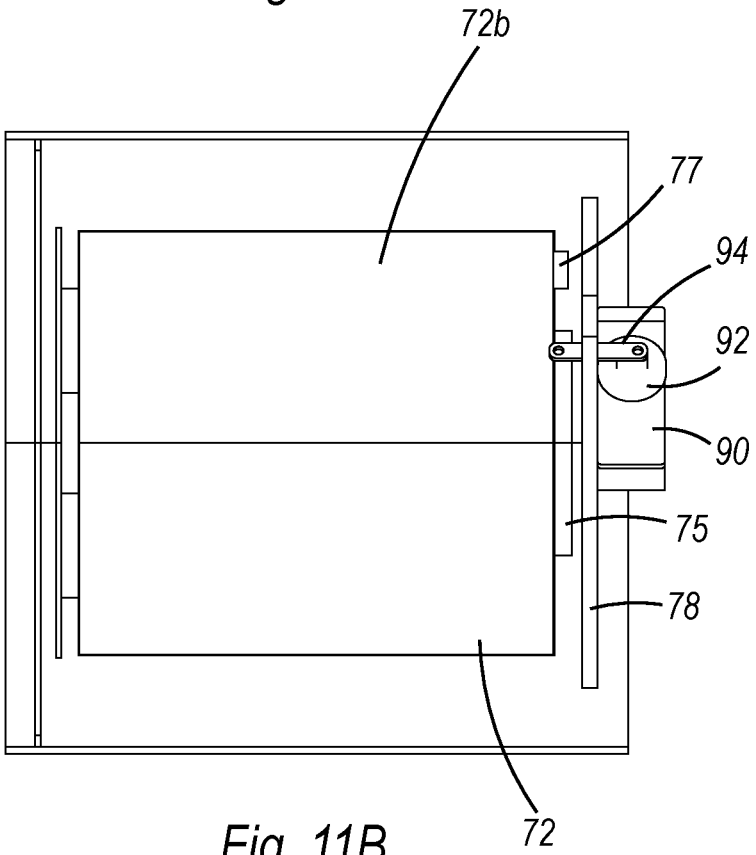
Figure 11C:
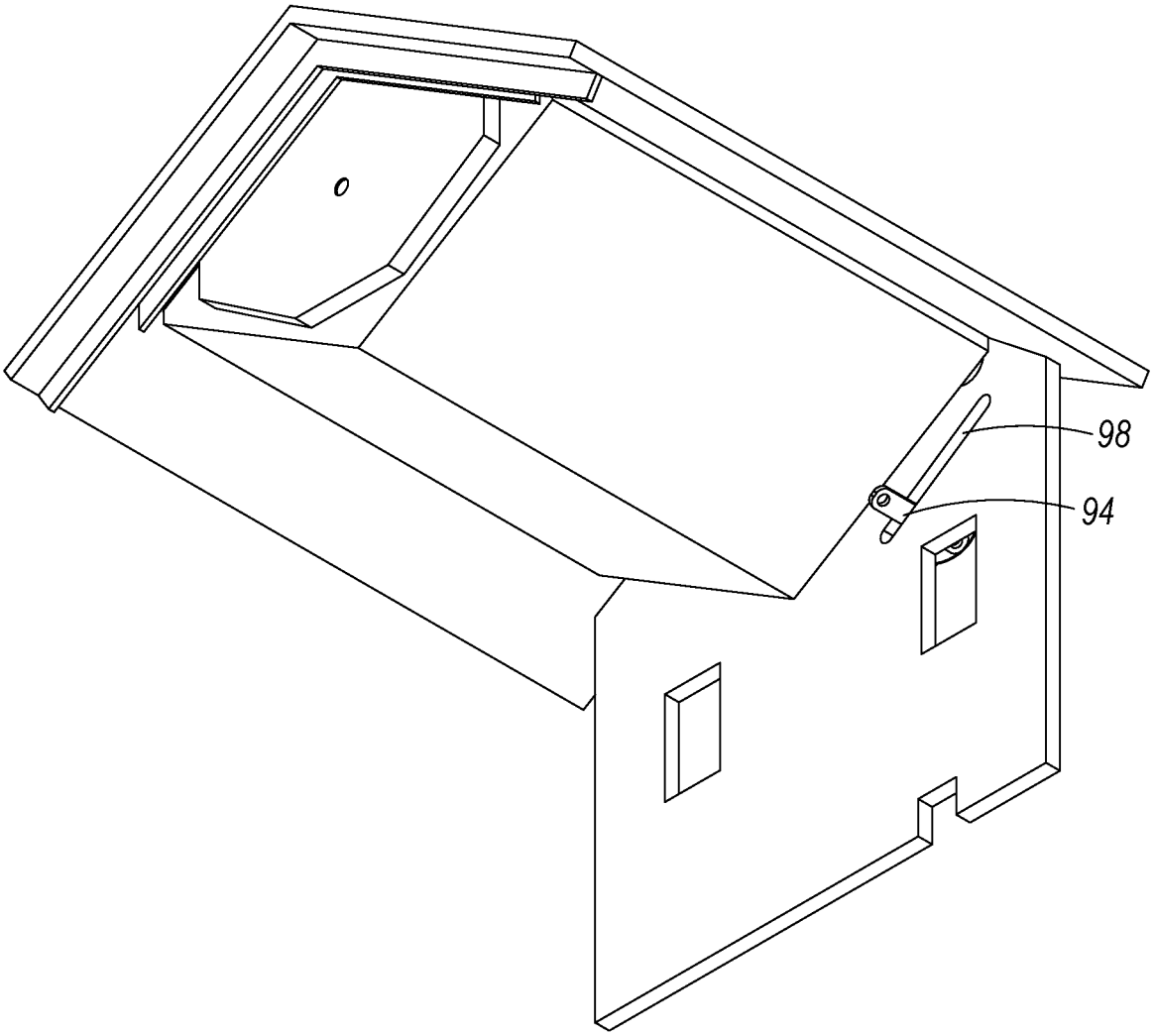

FIGS. 11A, 11B, and 11C illustrate the roof servomotor 90 according to an embodiment of the disclosure. As shown in FIG. 11A, servomotor 90 is mounted to one of keeper plates 75 and positioned so that its capstan 92 rotates in a plane aligned with the surface 72*b* of transformative section 72 when section 72 is positioned with surface 72*b* facing downward. In the examples given above, in this position first surface 72*a* is facing upward and forms part of the first scene, i.e., a house in warm weather. FIG. 11B is a view from below structure 70 looking upward at transformative section 72. Capstan 92 of servomotor 90 is connected with actuator arm 94. Actuator arm 94 extends through a slot in keeper plate 78. In the position shown in FIG. 11B, actuator arm 94 contacts an edge of end cap 75 of transformative section 72 and prevents section 72 from rotating. In this position, first surface 72*a* is held upward so that the display depicts the first scene. Stop block 77 extends from section 72. FIG. 11C shows a perspective view of structure 70 with some walls removed. Actuator arm 94 extends inward through a slot 98 in keeper plate 78. In this embodiment, keeper plate 78 forms one wall of structure 70.

When roof servomotor 90 is energized, capstan 92 rotates, pulling actuator arm 94 in the outward direction through the slot in keeper plate 75. This disengages actuator arm 94 from end cap 75. Because transformative section 72 is weighted to bring second surface 72*b* upward, disengaging the actuator arm from the end cap causes transformative section 72 to turn over, bringing second surface 72*b* to the top. When section 72 has rotated 180 degrees, stop block 77 contacts the underside of roof frame 76 so that second surface 72*b* is aligned with roof frame 76. Actuation of roof servomotor 90 may be simultaneous with actuation of panel servomotor 50 so that panels 4*a*, 4*b*, 4*c*, move from their first horizontal position to their second vertical position covering the walls of structure 50 at the same time the transformative section 72 of the roof of the structure rotates to complete the transformation from a first scene (e.g., a house in summer) to the second scene (e.g., the house in winter).

While illustrative embodiments of the disclosure have been described and illustrated above, it should be understood that these are exemplary of the disclosure and are not to be considered as limiting. Additions, deletions, substitutions, and other modifications can be made without departing from the spirit or scope of the disclosure. Accordingly, the disclosure is not to be considered as limited by the foregoing description.

We claim:

1. A transformative display comprising:

a substrate platform having an upper surface and one or more recesses;

a latch operator; and one or more panels, wherein each panel comprises:

a substantially planar body shaped to fit within respective ones of the recesses when the display is in a first configuration a hinge connecting an edge of the panel with an edge of the recess, the hinge adapted to allow the panel to rotate about a hinge axis from the first configuration to a second configuration, wherein, in the second configuration the panel extends out of the recess;

a bias mechanism connected with the panel and/or the hinge providing a bias force to drive the panel from the first configuration to the second configuration; and a latch connected with the platform and releasably connected with the panel to hold the panel in the first configuration against the bias force, wherein the latch operator actuates latches of each of the panels and wherein, when the latch of the panel is actuated, the panel moves from the first configuration to the second configuration subject to the bias force.

2. The display of claim 1, wherein the planar body has a first side and a second side, wherein, in the first configuration the first side faces upward from the recess and the second side faces downward in the recess.

3. The display of claim 2, wherein a first decorative scene is provided on the first side and a second decorative scene is provided on the second side, and wherein the first scene is visible in the first configuration and the second scene is visible in the second configuration.

4. The display of claim 1, wherein the bias mechanism comprises one or more springs.

5. The display of claim 4, wherein the bias mechanism further comprises an arm extending from the panel and movable along an arcuate path, wherein the spring acts on an end of the arm to generate the bias force.

6. The display of claim 3, comprising a plurality of panels disposed in a respective plurality of recesses, wherein, in the first configuration first sides of the panels face upward from the recesses to display a plurality of elements of the first scene and in the second configuration, the second panels extend from the recesses to display a plurality of elements of the second scene.

7. The display of claim 6, wherein at least one of the plurality of panels comprises an extension element extending from the first side, wherein, in the first configuration the extension element extends substantially vertically with respect to the upper surface and, in the second configuration, the extension element extends substantially horizontally with respect to the upper surface.

8. The display of claim 7, wherein two or more panels comprise extension elements, and wherein, in the second configuration extension elements of the two or more panels contact one another.

9. The display of claim 6, wherein the latch operator is adapted to actuate at least one of the panels in a time sequence with respect to at least one other of the plurality of panels.

10. The display of claim 5, wherein the latch operator comprises:

a plurality of control cables connected with respective ones of the latches; and an actuator mechanism adapted to apply tension to the cables, wherein tension is applied to the respective latch to actuate the latch.

11. The display of claim 10, wherein the actuator mechanism comprises one or more of a lever, a servomotor, a solenoid, a pneumatic actuator, and a hydraulic actuator.

12. The display of claim 1, further comprising a decorative figure connected with the second side of the panel or a bottom surface of the recess by an elastically resilient connection, wherein, when the panel is in the first configuration, the decorative figure is held between the bottom of the recess and the second side and, in the second configuration, the decorative figure resiliently extends from the second side or the bottom of the recess.

13. The display of claim 1, further comprising a resilient decorative feature disposed in the recess, wherein, when the panel is in the first configuration, the resilient decorative feature is compressed and is entirely below the upper surface, when the panel is in the second configuration, the resilient feature expands upward in the recess.

14. The display of claim 1, further comprising a structure connected with the platform substrate and extending upward from the platform substrate, the structure comprising one or more vertical walls, wherein a bottom edge of the wall is aligned with the hinge of the panel, and wherein, when the panel is in the second configuration, the panel covers at least a portion of the vertical wall.

15. The display of claim 14, wherein the structure further comprises a roof, wherein the roof comprises a transformative section rotatably mounted to the structure, wherein the transformative section comprises a first roof surface decorated to correspond with the first scene and a second roof surface decorated to correspond with the second scene.

16. The display of claim 15, wherein the transformative section is balanced so that, when unsupported, the second surface is positioned upward.

17. The display of claim 16, further comprising a roof actuator, wherein the roof actuator supports the transformative section to position the first surface upward, and wherein, when the actuator is actuated, the transformative section rotates so the second roof surface is positioned upward.

* * * * *